US008267260B2

(12) United States Patent
Zhang et al.

(10) Patent No.: US 8,267,260 B2
(45) Date of Patent: Sep. 18, 2012

(54) STORAGE DEVICE

(75) Inventors: Da-Liang Zhang, Taipei (TW); Chih-Wei Wang, Taipei (TW)

(73) Assignee: Excellerate Enterprise Co., Ltd., Taipei (TW)

( * ) Notice: Subject to any disclaimer, the term of this patent is extended or adjusted under 35 U.S.C. 154(b) by 236 days.

(21) Appl. No.: 12/617,283

(22) Filed: Nov. 12, 2009

(65) Prior Publication Data

US 2010/0122962 A1 May 20, 2010

(30) Foreign Application Priority Data

Nov. 14, 2008 (CN) ..... 2008 2 0140370 U

(51) Int. Cl.
*A47F 5/08* (2006.01)

(52) U.S. Cl. ..... 211/118; 211/10; 211/119.006; 383/23; 383/38; 190/109; 220/507

(58) Field of Classification Search ..... 211/85.2, 211/36, 38, 10, 75, 119.006, 118, 119.003, 211/119.004, 119.007; 383/26, 12, 13, 38, 383/66, 23; 224/409, 411, 449, 560; 206/806, 206/217; 220/507, 529, 482, 480, 23.4; 190/24, 190/122, 109

See application file for complete search history.

(56) References Cited

U.S. PATENT DOCUMENTS 752,004 A * 2/1904 Simons ..... 224/436
1,844,872 A * 2/1932 Shipman ..... 383/23
1,919,568 A * 7/1933 McCosh ..... 220/529
2,064,594 A * 12/1936 Dickey ..... 383/71
2,078,438 A * 4/1937 Baxter ..... 383/13
2,470,463 A * 5/1949 Botten ..... 119/65
2,517,757 A * 8/1950 Adlerstein ..... 312/3
2,633,287 A * 3/1953 Jacobsson ..... 206/162
2,757,699 A * 8/1956 Fancher et al. ..... 383/13
2,842,269 A * 7/1958 Gomersall ..... 211/41.2
4,140,163 A * 2/1979 Usner ..... 383/22
4,212,377 A * 7/1980 Weinreb ..... 190/109
4,327,835 A * 5/1982 Leger ..... 211/41.17
4,428,484 A * 1/1984 Rattay et al. ..... 206/548
4,819,793 A * 4/1989 Willard et al. ..... 206/162
4,960,211 A * 10/1990 Bailey ..... 211/60.1
5,050,998 A * 9/1991 Wachtel ..... 383/6
5,356,004 A * 10/1994 Weinreb ..... 206/316.2
5,413,215 A * 5/1995 Hardinger, Jr. ..... 206/308.1
5,503,476 A * 4/1996 Hamdan ..... 383/9
5,699,564 A * 12/1997 Heh ..... 5/503.1
5,868,227 A * 2/1999 Garcia ..... 190/112
6,062,410 A * 5/2000 Bradford et al. ..... 220/6
6,105,305 A * 8/2000 Edens ..... 43/54.1
6,302,281 B1 * 10/2001 Wang ..... 211/118
6,484,989 B1 * 11/2002 Connery ..... 248/311.2
6,659,273 B1 * 12/2003 Scola ..... 206/285
6,805,225 B2 * 10/2004 Freedman ..... 190/112
6,952,849 B2 * 10/2005 Pacella ..... 5/658

(Continued)

*Primary Examiner* — Darnell Jayne
*Assistant Examiner* — Devin Barnett
(74) *Attorney, Agent, or Firm* — Steptoe & Johnson LLP

(57) ABSTRACT

A storage device includes a supporting frame, a storage unit, a partitioning component, and a connecting belt. The supporting frame includes a hanger and is formed with an engaging hole. The storage unit is coupled detachably to the supporting frame, and includes a bottom wall and a surrounding wall cooperating with the bottom wall to define a storage space. The partitioning component is disposed in the storage unit for dividing the storage space into at least two compartments. The connecting belt is for connecting the partitioning component to the supporting frame.

15 Claims, 8 Drawing Sheets

U.S. PATENT DOCUMENTS 7,043,778 B1 * 5/2006 Georgitsis et al. ..... 5/93.1
7,114,300 B1 * 10/2006 Culp ..... 52/211
7,163,337 B2 * 1/2007 Penson ..... 383/38
7,243,884 B2 * 7/2007 Lawson et al. ..... 248/95
7,389,868 B2 * 6/2008 Lewand et al. ..... 206/6.1
7,416,065 B2 * 8/2008 Levinson et al. ..... 190/106
7,762,422 B2 * 7/2010 Dobrinski ..... 220/544
2002/0092789 A1 * 7/2002 Sauer et al. ..... 206/494
2003/0111434 A1 * 6/2003 Stoddart et al. ..... 211/118
2005/0074187 A1 * 4/2005 Sabounjian ..... 383/38
2006/0131312 A1 * 6/2006 Bradford et al. ..... 220/507
2007/0223842 A1 * 9/2007 Sabounjian ..... 383/2
2008/0110897 A1 * 5/2008 Bradford et al. ..... 220/507

* cited by examiner

STORAGE DEVICE

CROSS-REFERENCE TO RELATED APPLICATION

This application claims priority of Chinese Application No. 200820140370.5, filed on Nov. 14, 2008.

BACKGROUND OF THE INVENTION

1. Field of the Invention

The invention relates to a storage device, more particularly to a storage device facilitating storage of different kinds of articles.

2. Description of the Related Art

When taking care of their babies, parents have to prepare different kinds of articles, such as feeding bottles, diapers, baby wipes, toys, baby powder, and so on. Many parents leave some frequently used articles at corners of a baby crib for convenience sake. However, these items not only occupy the inner space of the baby crib for babies to move, but may be damaged since they are easily accessed by the babies.

U.S. Pat. No. 5,699,564 discloses a conventional storage device for storing articles of babies therein. As illustrated in FIGS. 1 and 2, the conventional storage device 1 comprises an exterior container 11 formed with a pair of spaced-apart apertures 111, an internal bag 12 disposed within the exterior container 11 and formed with a pair of spaced-apart apertures 121, and a pair of straps 13. Each of the straps 13 extends through a respective one of the apertures 111 in the exterior container 11 and a respective one of the apertures 121 in the internal bag 12, and has opposite ends connected respectively to a male buckle part 14 and a female buckle part 15. In use, the straps 13 are looped over a frame 21 of the baby crib 2 with the male buckle parts 14 engaging respectively the female buckle parts 15, thereby hanging securely the conventional storage device 1 on the baby crib 2.

However, since all kinds of articles are stored in the same interior bag 12 without classification, it is not convenient for parents to access a specific one of the articles.

SUMMARY OF THE INVENTION

Therefore, the object of the present invention is to provide a storage device facilitating storage and access of different articles for baby care.

Accordingly, a storage device of the present invention comprises a supporting frame, a storage unit, a partitioning component, and an elongated connecting belt. The supporting frame includes a hanger and is formed with an engaging hole. The storage unit is coupled detachably to the supporting frame, and includes a bottom wall and a surrounding wall extending upwardly from a periphery of the bottom wall and cooperating with the bottom wall to define a storage space. The partitioning component is disposed in the storage unit for dividing the storage space into at least two compartments. The connecting belt is for connecting the partitioning component to the supporting frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
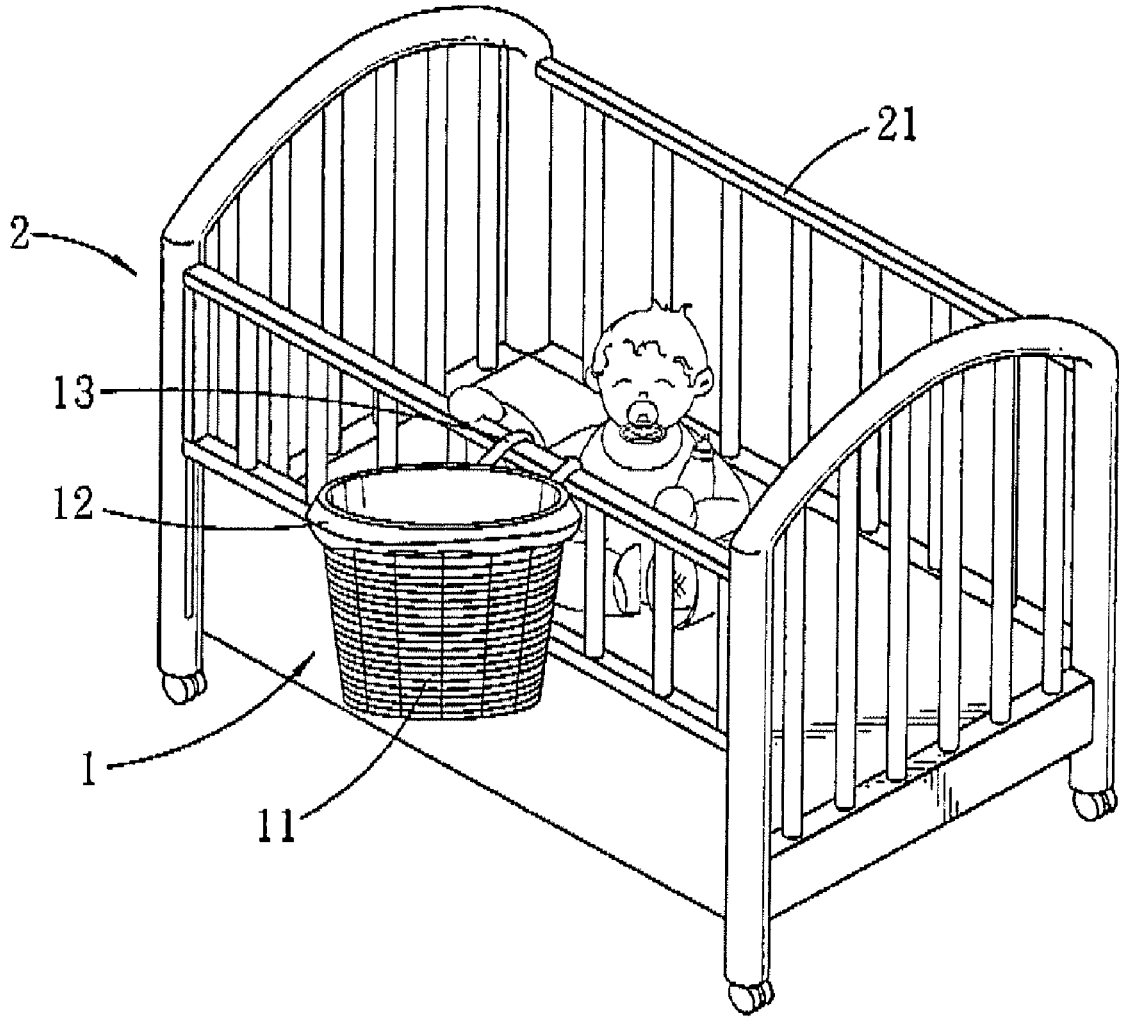
FIG. 1 PRIOR ART
FIG. 1 is a perspective view of a baby crib mounted with a conventional storage device that is disclosed in U.S. Pat. No. 5,699,564.
Figure 2:
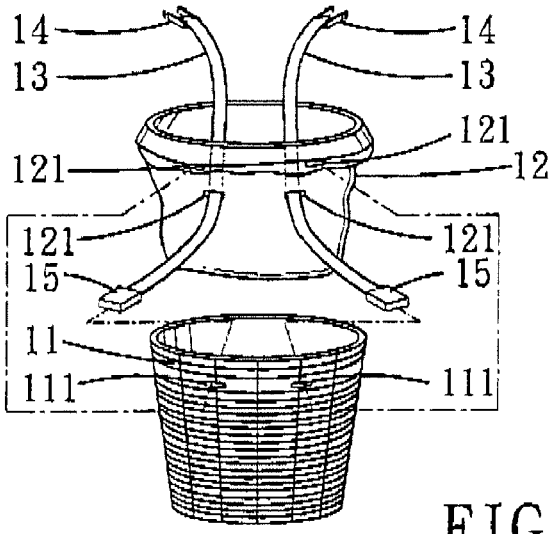
FIG. 2 PRIOR ART
FIG. 2 is an exploded perspective view of the conventional storage device disclosed in U.S. Pat. No. 5,699,564.
Figure 3:
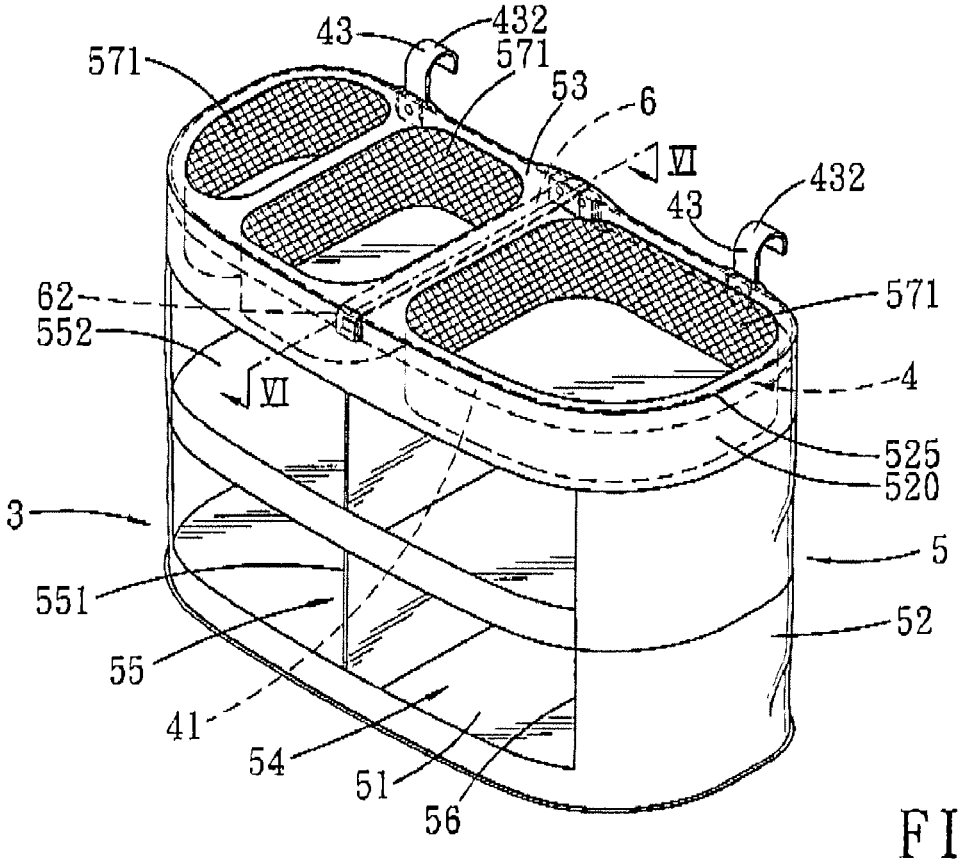
FIG. 3 is an assembled perspective view of a preferred embodiment of a storage device according to the invention.
Figure 4:
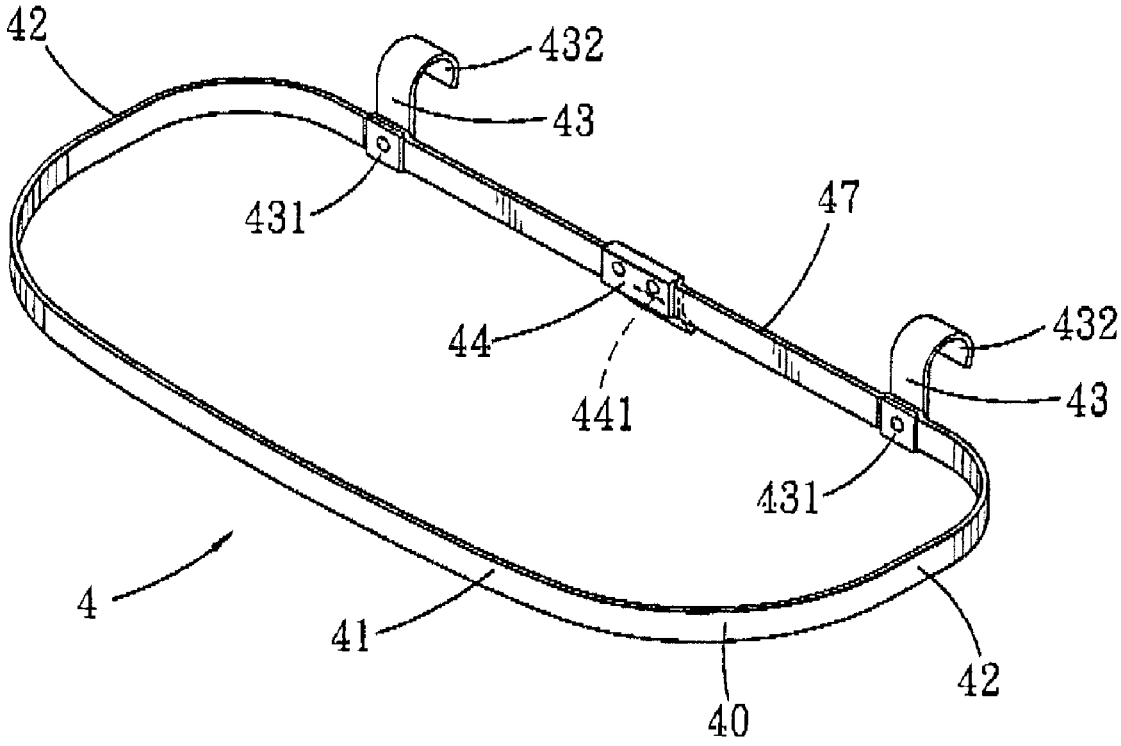
FIG. 4 is a perspective view of a supporting frame of the preferred embodiment.

As shown in FIGS. 3 and 4, the preferred embodiment of a storage device 3 according to the present invention comprises a supporting frame 4, a storage unit 5 coupled detachably to the supporting frame 4, a partitioning component 55, and a connecting belt 6.

In this embodiment, the supporting frame 4 is formed as an elongated loop, and includes a frame body 40 that has a pair of parallel elongated front and rear side parts 41, 47, and a pair of spaced-apart curved side parts 42 interconnecting the front and rear side parts 41, 47. The supporting frame 4 further includes a pair of hangers 43 and a positioning plate 44. The hangers 43 are mounted to the rear side part 47 and are spaced apart from each other. In this embodiment, each of the hangers 43 has a fixed end 431 connected fixedly to the rear side part 47 of the frame body 40, and a hook end 432 opposite to the fixed end 431. The positioning plate 44 is connected fixedly to the frame body 40 and is formed with an engaging hole 441.

Figure 7:
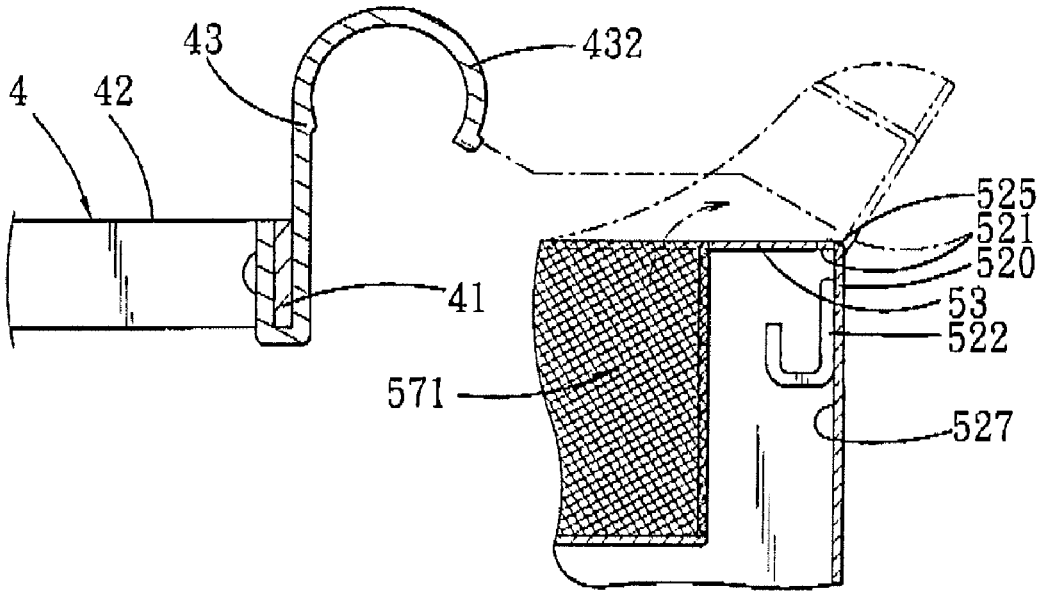
FIG. 7 is a fragmentary exploded sectional view of a hanger and a storage unit.
Figure 8:
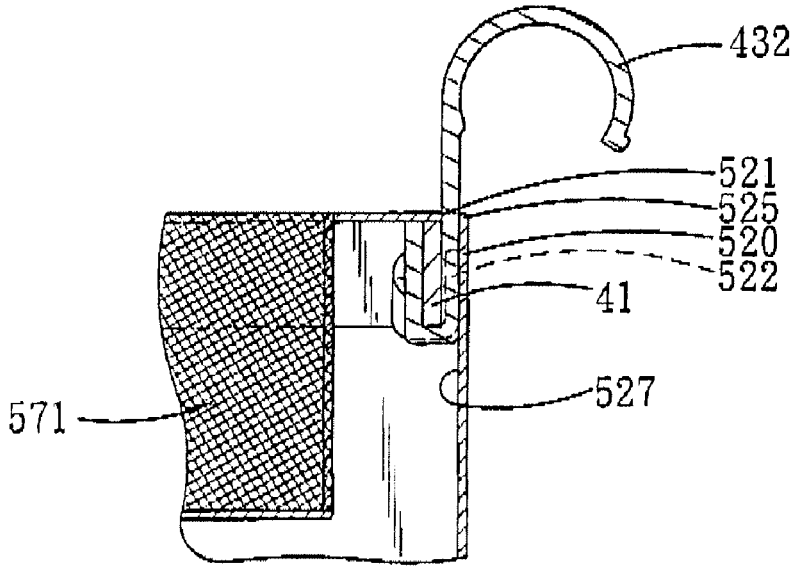
FIG. 8 is a fragmentary assembled sectional view of the hanger and the storage unit.

Referring to FIG. 3, in this embodiment, the storage unit 5 is made of a flexible material, such as canvas, plastic cloth, and so on. The storage unit 5 includes a bottom wall 51, a surrounding wall 52, and a top wall 53. The surrounding wall 52 extends upwardly from a periphery of the bottom wall 51, has a top portion 520 vertically opposite to the bottom wall 51, cooperates with the bottom wall 51 to define a storage space 54, and is formed with an opening 56 that is in spatial communication with the storage space 54. With further reference to FIGS. 7 and 8, the top portion 520 of the surrounding wall 52 has a top edge 525, and an inner surface 527 that confronts the storage space 54. The top portion 520 further has a pair of spaced-apart through holes 521 adjacent to the top edge 525. In this embodiment, the storage unit 5 further includes a plurality of couplers 522 mounted on the inner surface 527 for clamping resiliently the supporting frame 4 thereon. The top wall 53 is connected to the top edge 525 of the surrounding wall 52, and is provided with different sizes of storage bags 571 that extend downwardly into the storage space 54.

Figure 5:
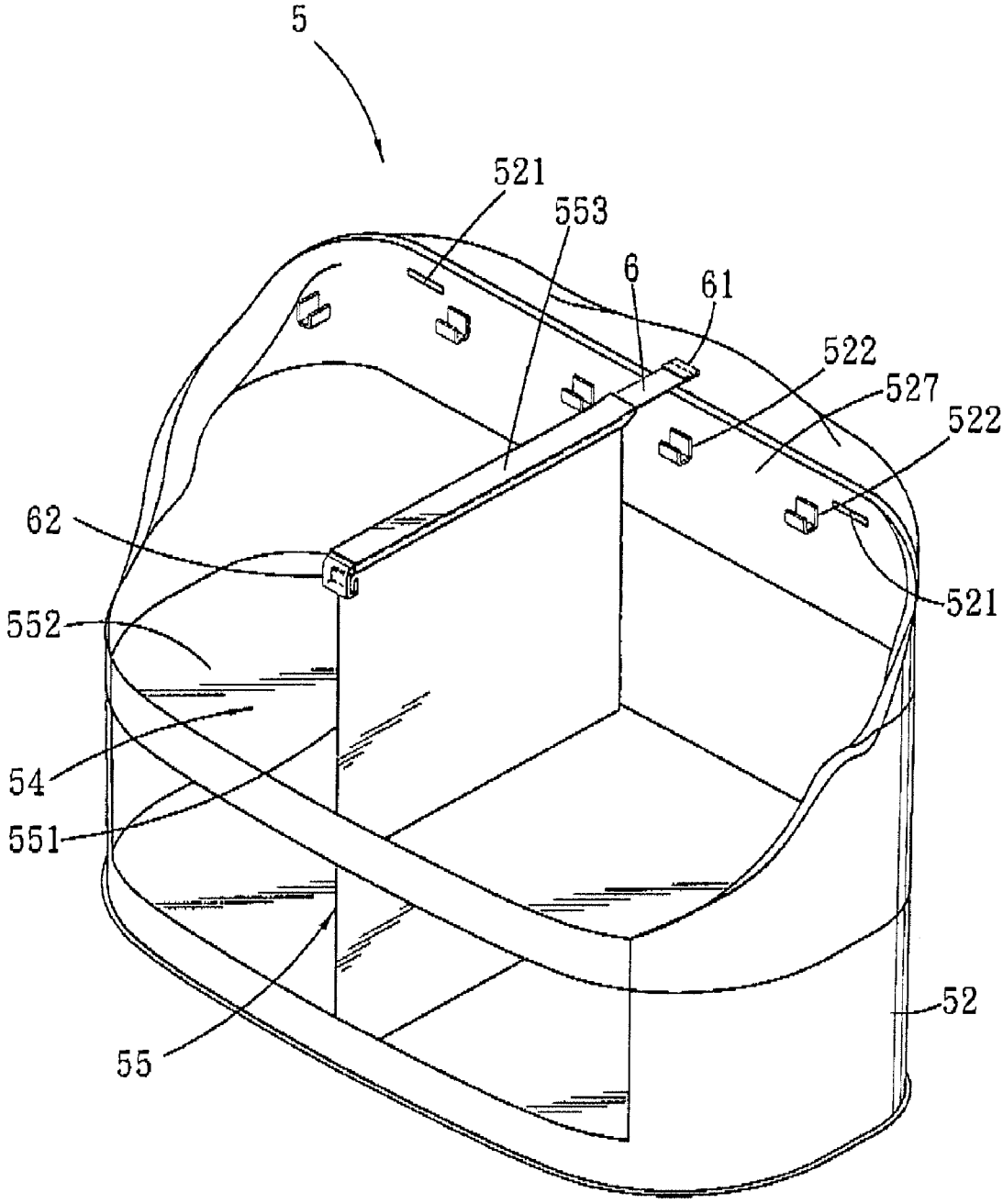
FIG. 5 is a partly cutaway perspective view of the preferred embodiment.

As shown in FIGS. 3 and 5, the partitioning component 55 is disposed in the storage space 54 for dividing the storage space 54 into a plurality of compartments, and each compartment has an easy and individual access through the opening 56 on the surrounding wall 52. In this embodiment, the partitioning component 55 includes a first partitioning wall 551 extending vertically and connected to the bottom wall 51 and the surrounding wall 52 of the storage unit 5, and a second partitioning wall 552 extending horizontally and connected to the surrounding wall 52 and the first partitioning wall 551. The first partitioning wall 551 has a top end formed with a tubular sleeve portion 553.

Figure 6:
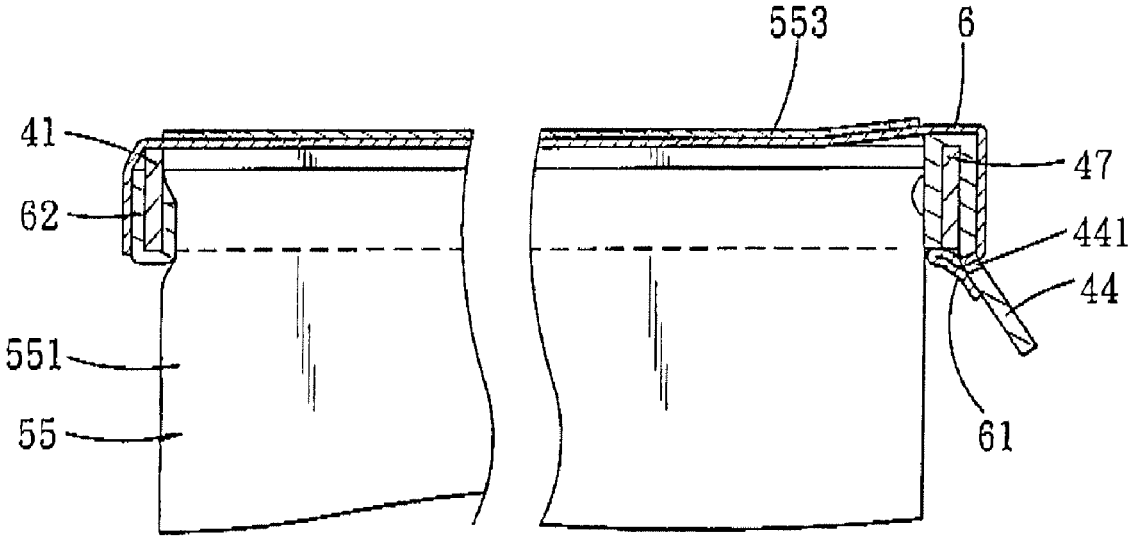
FIG. 6 is a fragmentary sectional view of the preferred embodiment taken along line VI-VI in FIG. 3.

Referring to FIGS. 5 and 6, the connecting belt 6 extends through the sleeve portion 553 of the first partitioning wall 551 of the partitioning component 55. The connecting belt 6 may be made of a flexible material, such as non-woven fabrics, or of a stiff material, such as plastic. The connecting belt 6 has a first positioning end 61, and a second positioning end 62 that is opposite to the first positioning end 61 and that is provided with a positioning hook.

The storage device 3 of the preferred embodiment can be easily assembled and disassembled, as described hereinafter. As shown in FIGS. 5 and 6, when assembling the storage device 3 of the preferred embodiment, the first positioning end 61 of the connecting belt 6 is first extended through the engaging hole 441 in the positioning plate 44 which is connected to the rear side part 47 of the supporting frame 4. Next, the positioning hook of the second positioning end 62 of the connecting belt 6 is coupled to the front side part 41 of the frame body 40 of the supporting frame 4, such that the looped first positioning end 61 engages the positioning plate 44 of the supporting frame 4, thereby tightening the connecting belt 6 between the front and rear side parts 41, 47. In particular, the first positioning end 61 of the connecting belt 6 is folded and stitched to form a loop after being extended through the engaging hole 441 in the positioning plate 44 to prevent separation of the first positioning end 61 from the engaging hole 441, thereby ensuring a better connection therebetween. Afterward, with further reference to FIGS. 7 and 8, the hook ends 432 of the hangers 43 of the supporting frame 4 are extended respectively through the through holes 521 in the top portion 520 of the surrounding wall 52 of the storage unit 5, and the couplers 522 are coupled on the rear side part 47 of the supporting frame 4, followed by covering the top wall 53 and the surrounding wall 52 on the supporting frame 4, thereby finishing the assembling process.

On the contrary, the storage device 3 of the preferred embodiment can be disassembled by disengaging the couplers 522 of the storage unit 5 from the supporting frame 4, uncovering the frame body 40, disengaging the second positioning end 62 of the connecting belt 6 from the frame body 40, and removing the first positioning end 61 of the connecting belt 6 from the positioning plate 44 of the supporting frame 4. The removed storage unit 5 can be folded, thereby facilitating storage of the storage device 3 of the present invention.

Figure 9:
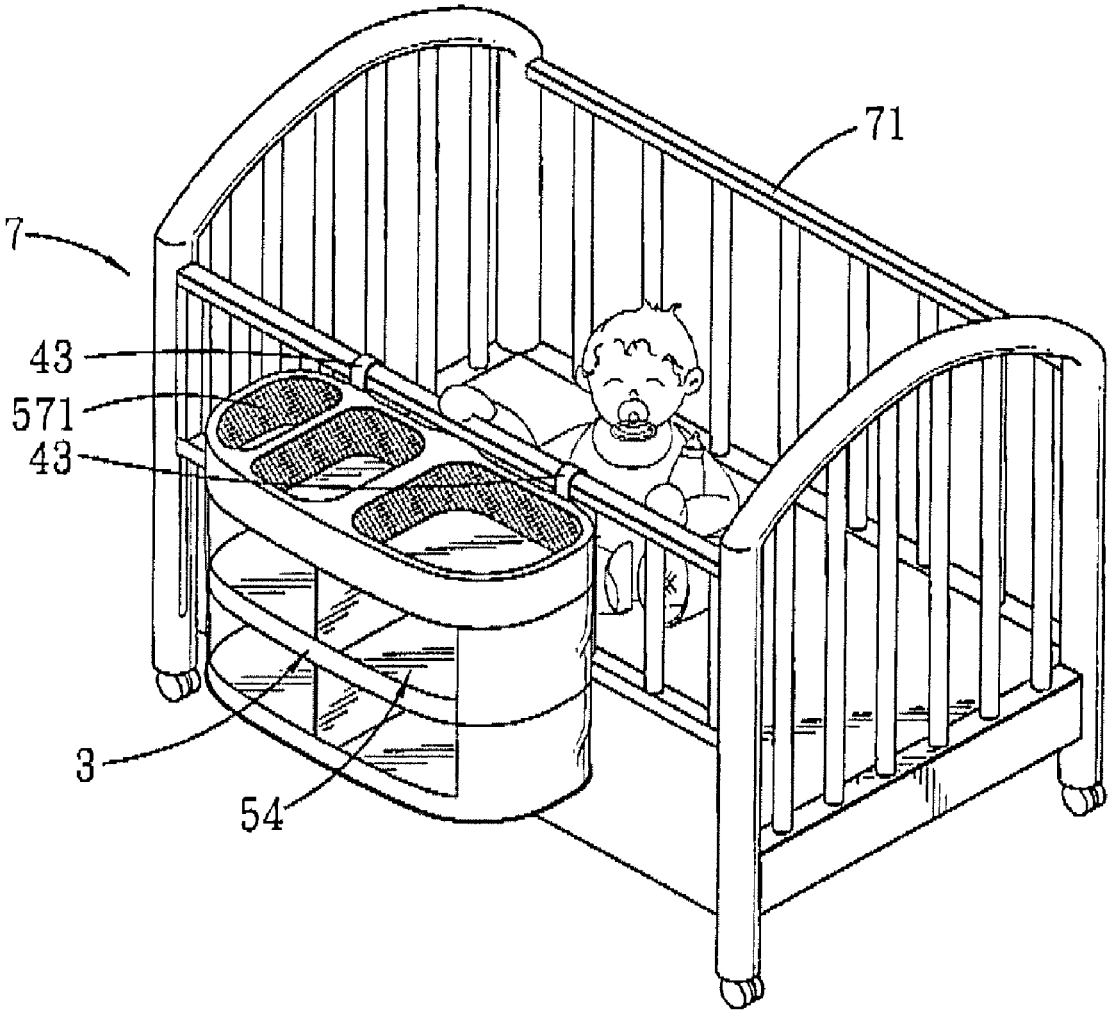
FIG. 9 is a perspective view of a baby crib mounted with the preferred embodiment.
Figure 10:
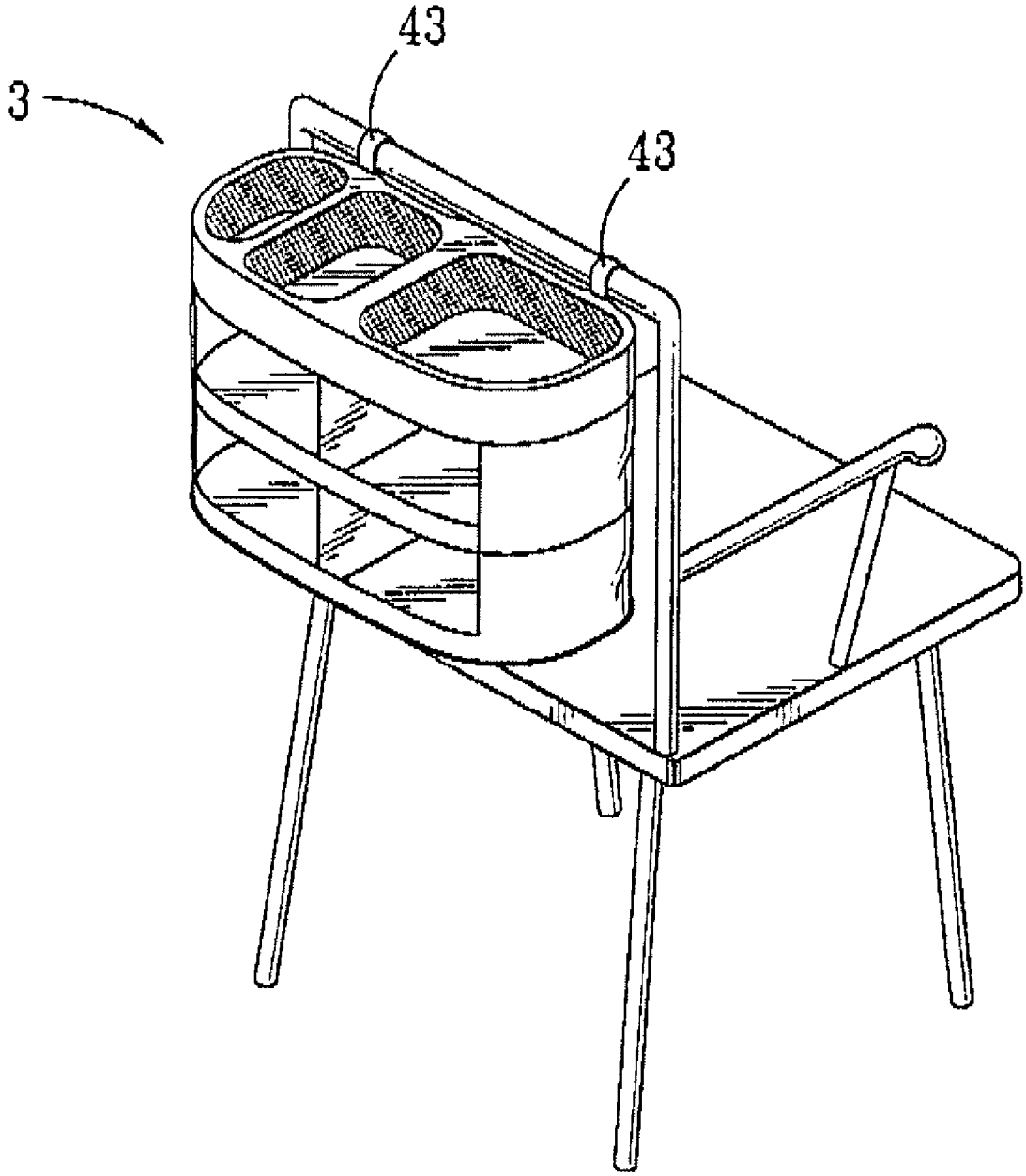
FIG. 10 is a perspective view of a chair mounted with the preferred embodiment.

Referring to FIG. 9, in use, the storage device 3 of the present invention can be hung on a frame structure 71 of a baby crib 7 through the hangers 43. The storage device 3 can also be hung on other kinds of furniture. For example, as illustrated in FIG. 10, the storage device 3 can be hung on a backrest of a highchair for babies.

Compared to the prior art, the partitioning component 55 divides the storage space 54 into the compartments, such that different kinds of baby care articles can be stored orderly in the different compartments. Therefore, parents can easily access a desired one of the baby care articles.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A storage device comprising:

a supporting frame including a hanger, and formed with an engaging hole;

a storage unit coupled detachably to said supporting frame, and including a bottom wall, and a surrounding wall that extends upwardly from a periphery of said bottom wall and that cooperates with said bottom wall to define a storage space;

a partitioning component disposed in said storage unit for dividing said storage space into at least two compartments; and an elongated connecting belt connected to said partitioning component and having a first positioning end that extends removably through said engaging hole of said supporting frame;

wherein said connecting belt further has a second positioning end opposite to said first positioning end and connected detachably to a portion of said supporting frame opposite to said engaging hole; and wherein said first positioning end of said connecting belt is folded and stitched to form a loop.

2. The storage device as claimed in claim 1, wherein said supporting frame further includes a frame body, said hanger of said supporting frame having a fixed end that is connected fixedly to said frame body, and a hook end opposite to said fixed end.

3. The storage device as claimed in claim 1, wherein said supporting frame further includes a frame body, and a positioning plate connected fixedly to said frame body and formed with said engaging hole.

4. The storage device as claimed in claim 1, wherein said surrounding wall of said storage unit is formed with an opening for said storage space in said storage unit.

5. The storage device as claimed in claim 1, wherein said partitioning component includes a first partitioning wall connected to said bottom wall of said storage unit.

6. The storage device as claimed in claim 5, wherein said first partitioning wall of said partitioning component has a sleeve portion sleeved on said connecting belt.

7. The storage device as claimed in claim 6, wherein said first partitioning wall of said partitioning component extends vertically, said partitioning component further including a second partitioning wall that extends horizontally and that is connected to said surrounding wall of said storage unit.

8. The storage device as claimed in claim 1, wherein said partitioning component includes a first partitioning wall connected to said surrounding wall of said storage unit.

9. The storage device as claimed in claim 8, wherein said first partitioning wall of said partitioning component has a sleeve portion sleeved on said connecting belt.

10. The storage device as claimed in claim 9, wherein said first partitioning wall of said partitioning component extends vertically, said partitioning component further including a second partitioning wall that extends horizontally and that is connected to said surrounding wall of said storage unit.

11. The storage device as claimed in claim 1, wherein:

said surrounding wall of said storage unit has a top edge vertically opposite to said bottom wall; and said storage unit further includes a top wall connected to said top edge of said surrounding wall and provided with a storage bag.

12. The storage device as claimed in claim 1, wherein:

said surrounding wall of said storage unit has a top portion opposite to said bottom wall and formed with a through hole; and said hanger of said supporting frame extends through said through hole.

13. The storage device as claimed in claim 1, wherein:

said surrounding wall of said storage unit has a top portion opposite to said bottom wall and having an inner surface that confronts said storage space; and said storage unit further includes a coupler mounted on said inner surface of said top portion of said surrounding wall for clamping resiliently said supporting frame thereon.

14. The storage device as claimed in claim 1, wherein said second positioning end of said connecting belt is provided with a positioning hook engaging detachably said portion of said supporting frame opposite to said engaging hole.

15. The storage device as claimed in claim 1, being adapted for use with a baby crib that has a frame structure, wherein said hanger is adapted to be coupled detachably to the frame structure of the baby crib.

* * * * *